US008490544B2

(12) United States Patent
Nitschke et al.

(10) Patent No.: US 8,490,544 B2
(45) Date of Patent: Jul. 23, 2013

(54) PAD PRINTING MACHINE

(75) Inventors: Oliver Nitschke, Eberdingen (DE); Wilfried Philipp, Kornwestheim (DE)

(73) Assignee: Tampoprint AG, Korntal-Muenchingen (DE)

( * ) Notice: Subject to any disclaimer, the term of this patent is extended or adjusted under 35 U.S.C. 154(b) by 381 days.

(21) Appl. No.: 12/911,951

(22) Filed: Oct. 26, 2010

(65) Prior Publication Data

US 2012/0073459 A1 Mar. 29, 2012

(30) Foreign Application Priority Data

Sep. 28, 2010 (DE) ..... 10 2010 041 522

(51) Int. Cl.
*B41F 17/00* (2006.01)

(52) U.S. Cl.
USPC ..... 101/41; 101/163; 101/327

(58) Field of Classification Search
USPC ..... 101/41, 44, 150, 163, 167, 169, 170, 101/327, 368
See application file for complete search history.

(56) References Cited

U.S. PATENT DOCUMENTS

| | | | | |
|---|---|---|---|---|
| 2,972,295 | A * | 2/1961 | Tiritilli | 101/40 |
| 4,060,031 | A * | 11/1977 | Philipp | 101/163 |
| 4,557,195 | A | 12/1985 | Philipp | |
| 4,905,594 | A | 3/1990 | Philipp et al. | |
| 5,694,839 | A * | 12/1997 | Wohl et al. | 101/39 |
| 5,921,177 | A | 7/1999 | Shin | |
| 5,950,534 | A * | 9/1999 | Philipp | 101/41 |
| 6,363,849 | B1 * | 4/2002 | Philipp | 101/163 |
| 6,813,998 | B2 * | 11/2004 | Roebuck | 101/41 |

FOREIGN PATENT DOCUMENTS

| | | |
|---|---|---|
| EP | 0 140 165 | 5/1985 |
| EP | 0 474 262 | 3/1992 |
| EP | 0 826 497 A2 | 3/1998 |
| EP | 0 826 498 A2 | 3/1998 |

* cited by examiner

*Primary Examiner* — Ren Yan
(74) *Attorney, Agent, or Firm* — Henry M. Feiereisen LLC

(57) ABSTRACT

A pad printing machine with a holder for a printing plate includes an ink supply device having a hollow body which rests with its front face on the printing plate during operation of the machine, a device for producing a relative movement between the printing plate and the hollow body, and a printing pad which can be pressed onto the inked printing plate and receives the ink from recesses in the printing plate and transfers the ink to an object to be printed. The drive assembly for the relative movement between the hollow body and the printing plate has a rotatably driven first cam and the drive assembly for the pad has a rotatably driven second cam, wherein both cams are arranged on a single control disc.

22 Claims, 4 Drawing Sheets

PAD PRINTING MACHINE

CROSS-REFERENCES TO RELATED APPLICATIONS

This application claims the priority of German Patent Application, Serial No. 10 2010 041 522.7, filed Sep. 28, 2010, pursuant to 35 U.S.C. 119(a)-(d), the content of which is incorporated herein by reference in its entirety as if fully set forth herein.

BACKGROUND OF THE INVENTION

The present invention relates to a pad printing machine with a holder for a printing plate, an ink supply device having a hollow body, wherein the hollow body rests with its front face on the printing plate during operation of the machine, a device for generating and relative movement between the printing plate and the hollow body, and a pad which can be pressed onto the inked printing plate and which takes up the ink from the recesses of the printing plate and transfers the ink to an object to be printed, wherein the drive assembly for the relative movement between the hollow body and the printing plate has a rotatably driven first cam and the drive assembly for the pad has a rotatably driven second cam.

In one conventional pad printing machine, the printing plate and the pad are driven by two separate levers operating on control discs, which generates play resulting in inaccurate prints. In another conventional pad printing machine, the pad is moved vertically by a guide member from an upper end position to a lower end position and back, wherein in the lower end position the pad is pressed onto the printing plate. The printing plate is simultaneously moved back and forth horizontally by a piston-cylinder unit, wherein the printing plate is inked in the first end position and the ink is lifted from the printing plate by the pad in the other end position. Both these pad printing machines have only a limited printing speed.

It would therefore be desirable and advantageous to address this problem and to obviate other prior art shortcomings by providing a pad printing machine which enables a higher printing speed.

SUMMARY OF THE INVENTION

According to one aspect of the present invention, a pad printing machine includes a printing plate, a holder for the printing plate, an ink supply device having a hollow body with a front face, wherein the front face of the hollow body rests on the printing plate during operation of the machine, a printing pad constructed to receive ink from recesses disposed in the printing plate, when pressed against the printing plate, and to transfer the received ink to an object to be printed, and a single control disc having a rotatably driven first cam engaging with a first drive assembly that produces a relative movement between the printing plate and the hollow body, and a rotatably driven second cam engaging with a second drive assembly that produces movement of the pad.

By arranging the drive assembly according to the invention, i.e., by arranging both cams on a single control disc, the pad and the printing plate advantageously always move with a defined mutual relationship, because both cams cannot be displaced with respect to each other. In addition, the installation time for the pad printing machine is also reduced, and the time for adjusting the cams is eliminated, which is required for cams arranged on separate discs. These control discs must be rotated relative to one another until the movements of the pad and the printing plate are exactly matched. For withdrawing the ink, the printing plate must not only be precisely positioned at the predetermined position, but must also retain this position during the entire ink withdrawal process. This is guaranteed with the pad printing machine according to the invention.

According to an advantageous embodiment of the invention, the first and/or the second cam may be formed by ribs or beads axially projecting from the control disc or by grooves formed in the control disc. The cams are here not located on the edge of the control disc, but rather on its side face. Preferably, one of the cams is located on one side face, while the other cam is located on the other side face.

According to another advantageous embodiment of the invention, the first and/or the second cam and the control disc are formed as a single piece.

In one embodiment, the holder may have two support rolls which engage with the first cam, allowing the printing plate to be moved to an inking position and to an ink withdrawal position, and a pivotally supported lever with two support rolls in engagement with the second cam, allowing the lever to be pivoted by the second cam in both pivoting directions, wherein the pad is coupled with the lever. Accordingly, in the pad printing machine according to the invention, the holder for the printing plate is directly provided with the support rolls, so that the holder can be driven directly by the first cam, thereby eliminating possible positional inaccuracies caused by play.

To ensure permanent contact between the support rolls and the cams, the ribs or beads may have uniform thickness in the radial direction. Because the webs or beads do not surround the support location in the form of a concentric circle, the wall thickness changes permanently. This not only results in a low noise level operation, but also produces a jerk-free movement at the reversal points were the pad or the printing plate reverse the movement direction.

In one exemplary embodiment of the invention, one of the two support rolls may be springily and/or adjustably attached on the holder and/or on the pivotally supported lever. In this way, the production-related play between the support rolls and the cam is compensated. In addition, installation of the support rolls on the cam is simplified.

Advantageously, the springily and/or adjustably supported support rolls may contact the first or the second cam with a pretension. In particular, one of the support rolls may be supported so as to be adjustable towards the cam. In this way, for example, the pretension can be generated and adjusted.

According to another advantageous exemplary embodiment of the invention, the second cam for the ink withdrawal position and optionally for the inking position may have a region shaped as a circular arc or a circle. Optimal printing results are obtained when the printing plate is completely at rest during ink withdrawal, i.e., during the time of the pad contacts the printing plate. This is attained by designing the cam as a circular arc, thereby eliminating (displacement) forces acting on the support roll(s). This can also be advantageous for the inking position, resulting in optimal inking of the engraving. The printing plate experiences maximum acceleration and deceleration between these positions.

Advantageously, the region for the inking position shaped as a circular arc or a circle may extend over an angular range of 40° to 120°, in particular 70° to 110°, and preferably 100°. Larger pads or pads with a larger diameter can then be used, because the printing plate remains in the inking position for a relatively long time and is hence retracted early and extended late.

Advantageously, the region for the ink withdrawal position shaped as a circular arc or a circle may extend over an angular range of 40° to 165°, in particular 70° to 155°, and preferably 145°. The pad can then be placed on the printing plate and lifted from the printing plate relatively slowly, thereby preventing or at least significantly reducing resonance oscillations of the pad.

To ensure that the pad is placed exactly on the printing plate, the pad is supported on a vertical linear guide. This prevents pivoting or displacement of the pad.

The pivoting motion of the lever is transferred to the linear guide by attaching the linear guide in a fork-shaped receptacle of the pivotally supported lever with a sliding block.

To reduce vibrations caused by the oscillation of the pad, a counterweight operates on the holder. The counterweight moves in the opposite direction relative to the printing plate, thereby producing mass inertia forces in opposite directions. The counterweight may be pivotally or displaceably supported on the housing of the pad printing machine. This aspect represents an independent inventive concept.

Advantageously, several control discs and/or several pad printing machines (10) can be driven with a single drive via a central driveshaft. In particular, work pieces can be printed several times, in particular with different inks. Several pad printing machines can also be synchronized in this way. By implementing the drive as an internal drive or an external drive, the pad printing machine can be coupled to the drive of production equipment.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
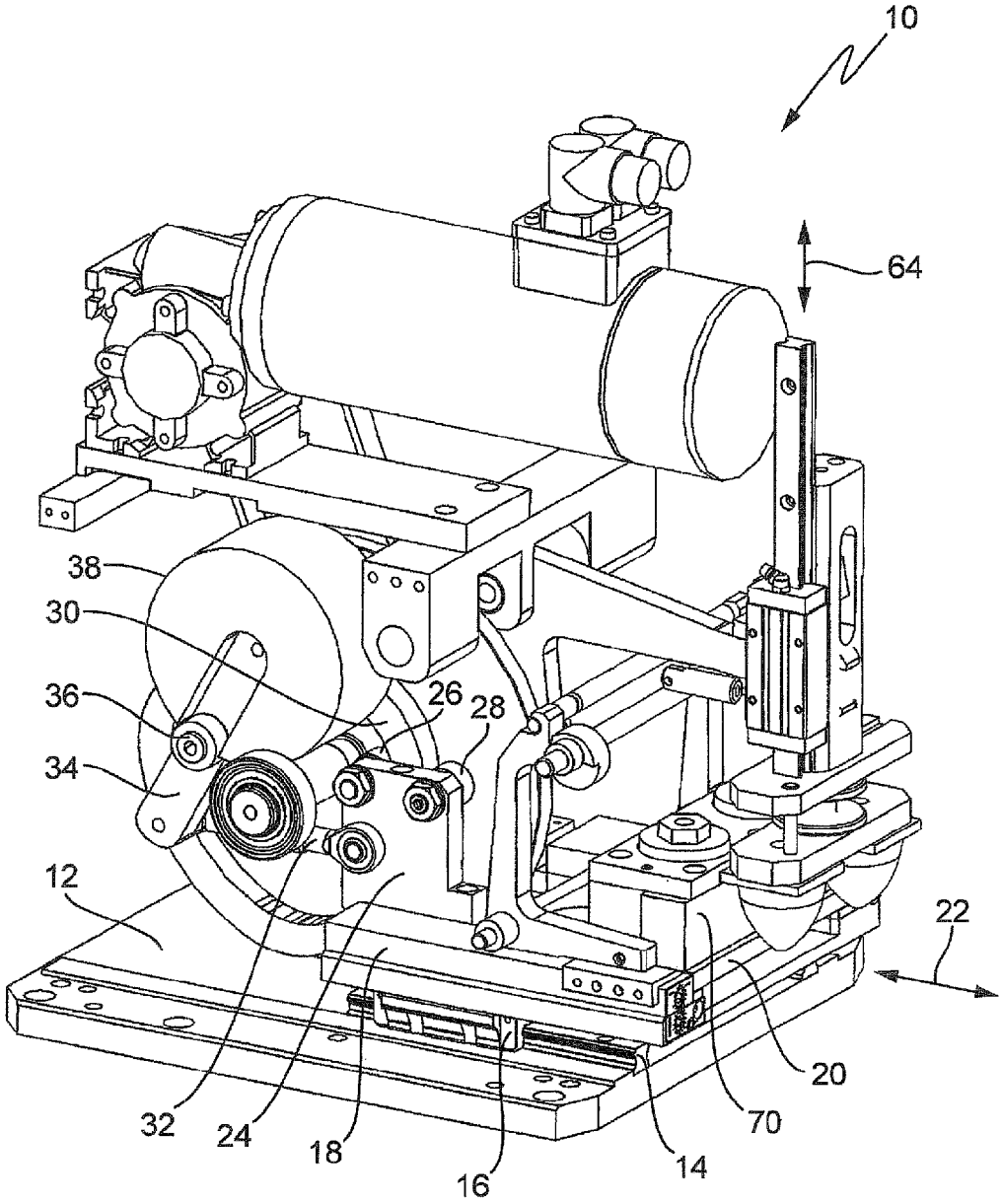
FIG. 1 shows a preferred exemplary embodiment of a pad printing machine according to the invention in a first perspective view.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 3:
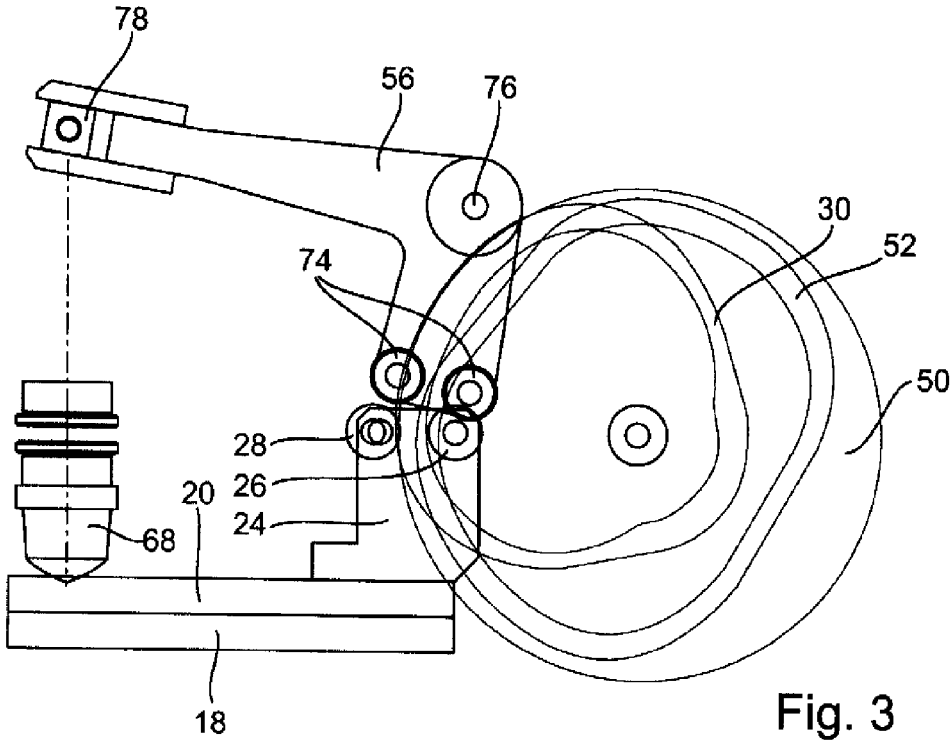
FIG. 3 shows the control disc with support rolls engaging with the cams in a first position of the pad and the printing plate in a schematic side view.
Figure 4:
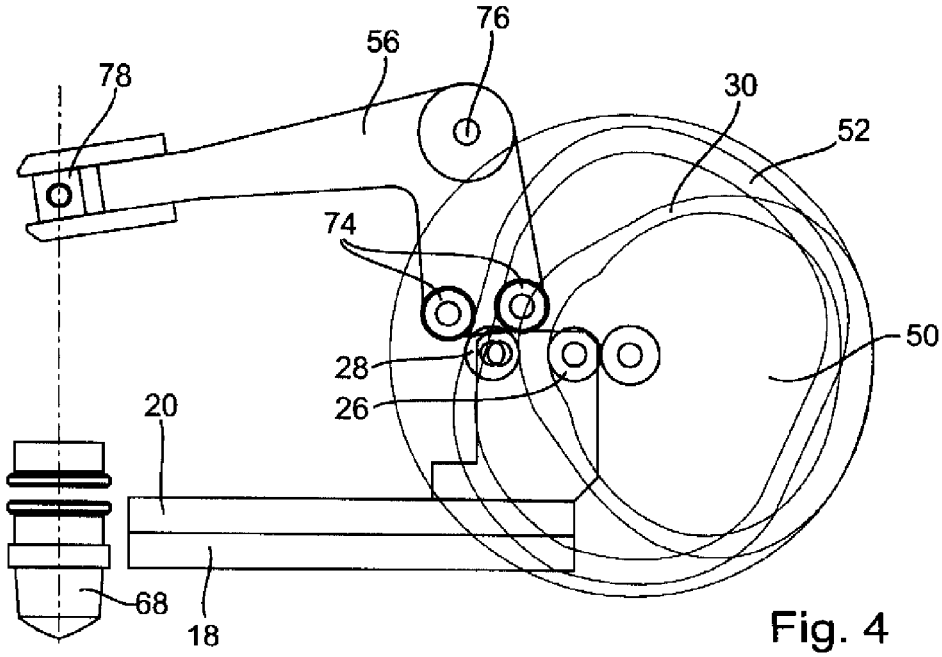
FIG. 4 shows the control disc with support rolls engaging with the cams in a second position of the pad and the printing plate in a schematic side view.

Turning now to the drawing, and in particular to FIG. 1, there is shown an exemplary embodiment of a pad printing machine 10, wherein only those components relevant for the invention are illustrated. Rails 14 for a carriage 16 are attached to a base plate 12, with a holder 18 for a printing plate 20 being mounted on the carriage 16. The holder 18 with the printing plate 20 can then move back and forth in the direction of the double arrow 22. For this purpose, two support rolls 26 and 28, which are supported on a first cam 30, are attached on the holder 18, in particular on a bearing 24. In addition, a toggle link 32, which engages with a lever 34 which is pivotally supported on a pivot bearing 36 affixed on the housing, is attached on the bearing 24. A counterweight 38 is placed on the other end of the lever 34, with the lever 34 pivoting outwardly when the carriage 16 with the holder 18 and the printing plate 20 moves out. As indicated in FIGS. 3 and 4, the support roll 28 is springily and optionally adjustably attached on the bearing 24.

Figure 2:
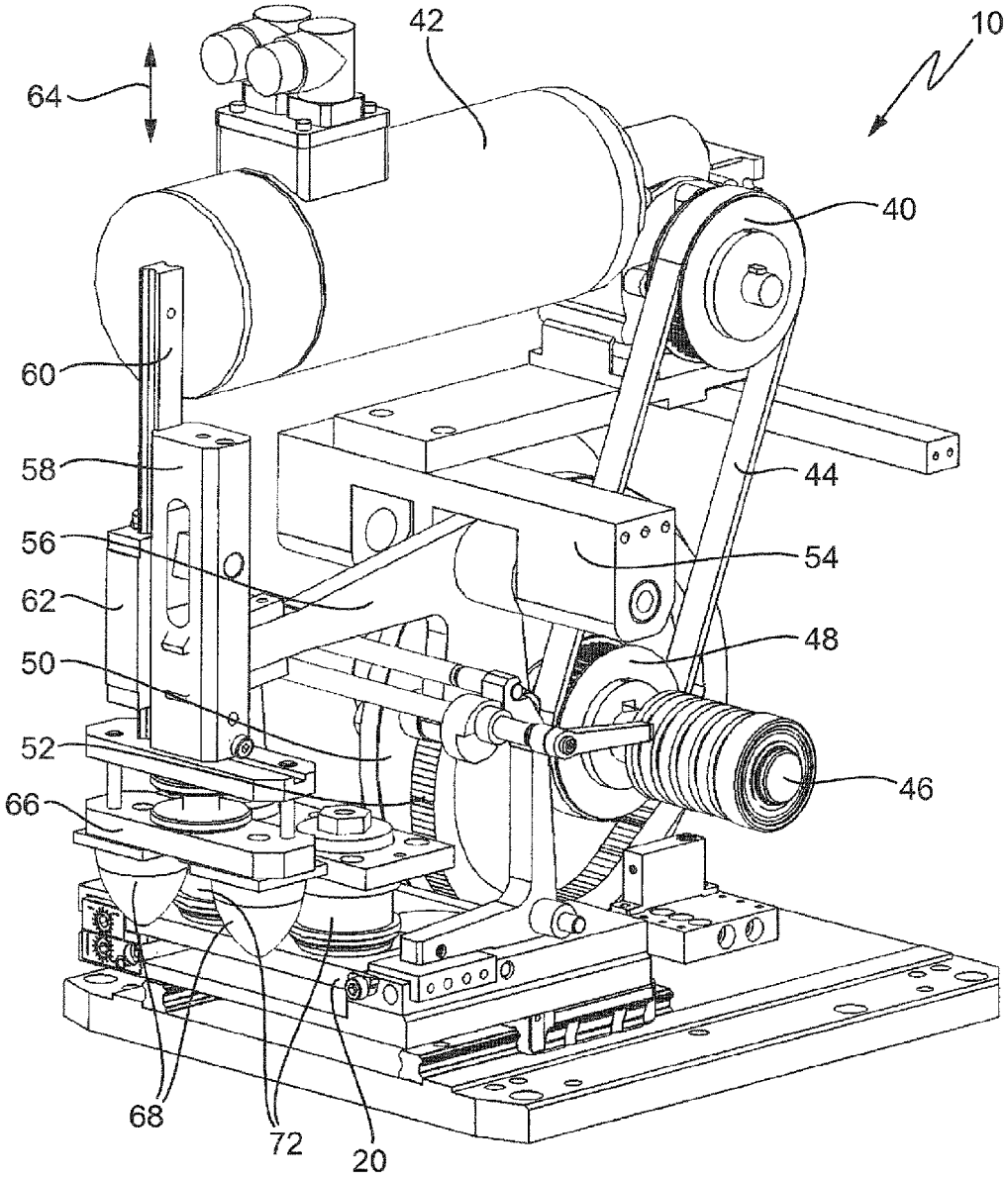
FIG. 2 shows the pad printing machine according to FIG. 1 in a second perspective view.

FIG. 2 shows a pad printing machine 10 from the other side, showing a driven wheel 40 of a drive 42, with a drive belt 44 extending around the driven wheel 40 and driving a drive wheel 48 disposed on a drive shaft 46. Also disposed on the drive shaft 46 is a control disc 50 having a second cam 52. The first cam 30 is located on the opposite side of the control disc.

A lever 56 with a pressure tappet 58 attached to an end of the lever 56 is pivotally supported on a bearing block 54. The end is constructed as a fork adapted to receive a sliding block 78 (FIGS. 3 and 4) which is rotatably supported on the pressure tappet 58 and movably supported in the fork. A linear guide rail 60, which is supported on a linear guide 62 affixed to the housing, is attached on the pressure tappet 58 for movement in the vertical direction 64. The length of the linear guide 62 is approximately half the length of the displacement travel, thereby preventing the pressure tappet 58 from tilting.

An adapter 66 is disposed on the end of the pressure tappet 58 facing the printing plate 20, wherein two printing pads 68 having lower ends located directly above the printing plate are attached to the adapter 66.

FIGS. 1 and 2 also show an ink supply device 70 with two hollow bodies 72 resting on the printing plate 20. The hollow bodies 72 containing ink are positioned so that the marginal region of their opening rests on the printing plate 20, whereby in the illustrated inking position the engraving of the printing plate 20 is inked with the ink.

FIG. 3 shows a schematic side view of the control disc 50, clearly showing the two cams 30 and 52 formed thereon. As mentioned above, the two support rolls 28 of the bearing 24 operate on the first cam 30. Two supports rolls 74, which are arranged on the other end of the lever 56 that is pivotally supported on the bearing 76, likewise operate on the second cam 52. The positions of the printing pad 68 and of the printing plate 20 illustrated in FIG. 3 represent the ink withdrawal position, where the printing plate 20 is moved out and the printing pad 68 is pressed onto the inked engraving of the printing pad 20, enabling the printing pad 68 to lift the ink from the engraving.

FIG. 4 shows the printing position where the printing plate 20 is retracted and the printing pad 68 carrying the ink is transferred onto the workpiece (not shown) located below the printing plate 20.

Figure 5:
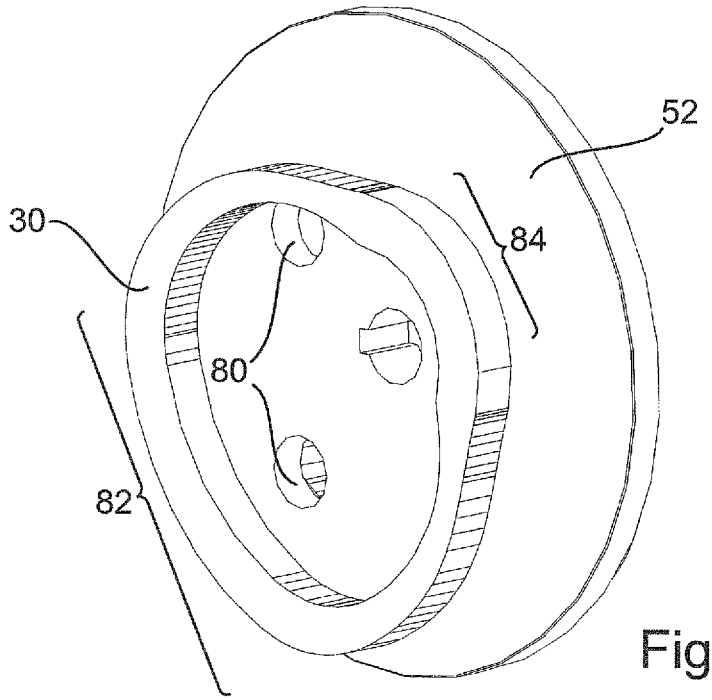
FIG. 5 shows a second perspective view of the control disc, showing the first cam.
Figure 6:
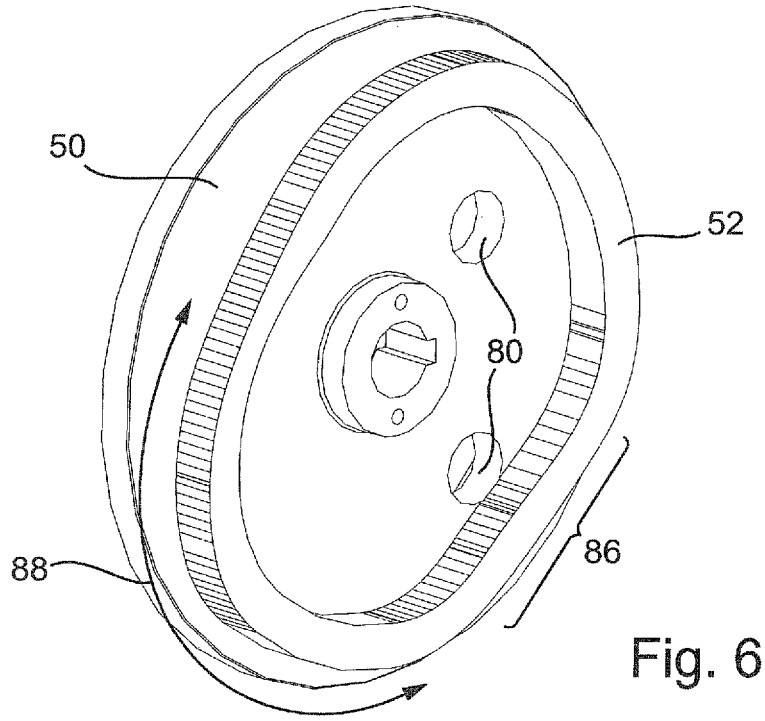
FIG. 6 shows a second perspective view of the control disc, showing the second cam.

The two FIGS. 5 and 6 show the control disc 50 with the bead-shaped or rib-shaped cams 30 and 52, which are formed as a single piece on the two front faces of the control disc. Because the control disc 50 is a single component, there is no risk that the two cams 30 and 52 can be displaced relative to each other. This not only facilitates the installation, because only a single component needs to be installed, but also shortens the installation time, because the two cams need not be adjusted. Also shown are equalizing bores 80 used to balance the control disc 50.

FIG. 5 clearly shows that the first cam 30 has two regions 82 and 84 in form of circular arcs which define the ink withdrawal position and the inking position for the printing plate 20. In between, the first cam 30 is shaped so that the printing plate 20 experiences maximum acceleration and deceleration. The printing plate 20 has two rest positions. Conversely, the second cam 52 is shaped so that the printing pad 68 is lifted briefly from the printing plate 20 after ink withdrawal (region 86), allowing the printing plate 22 to be retracted, whereafter the printing pad 68 is pressed relatively slowly onto the workpiece in the region 88. Because the printing plate 20 is retracted with high acceleration, the region 88 can be almost directly adjacent to the region 86. After printing, the printing pad 68 is lifted more quickly than it was pressed down. Due to the high acceleration and deceleration of the printing plate 20, it can remain at the two rest positions for a relatively long time, so that the printing pad 68 can, on one hand, be moved with reduced speed, thereby improving the print quality, and on the other hand, larger printing pads 68 can be used, because the time for moving the printing pad 68 past the printing pad 20 is relatively long.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A pad printing machine comprising:

a printing plate, a holder for the printing plate, an ink supply device having a hollow body with a front face, wherein the front face of the hollow body rests on the printing plate during operation of the machine, a printing pad constructed to receive ink from recesses disposed in the printing plate, when pressed against the printing plate, and to transfer the received ink to an object to be printed, and a single control disc having a rotatably driven first cam engaging with a first drive assembly that produces a relative movement between the printing plate and the hollow body, and a rotatably driven second cam engaging with a second drive assembly that produces movement of the pad, wherein the first cam or the second cam, or both, are formed by ribs or beads axially projecting from the control disc.

2. The pad printing machine of claim 1, wherein the ribs or beads have uniform thickness in a radial direction of the control disc.

3. The pad printing machine of claim 1, wherein the first cam or the second cam, or both, and the control disc are formed as a single piece.

4. The pad printing machine of claim 1, wherein the holder comprises two support rolls which engage with the first cam so as to move the printing plate to an inking position and to an ink withdrawal position.

5. The pad printing machine of claim 4, wherein one of the two support rolls is springily or adjustably attached on the holder.

6. The pad printing machine of claim 5, wherein the springily or adjustably supported support roll contacts the first cam with a pretension.

7. The pad printing machine of claim 1, comprising a pivotally supported lever having two support rolls which engage with the second cam so as to pivot the lever in opposing pivoting directions, wherein the printing pad is coupled with the lever.

8. The pad printing machine of claim 7, wherein one of the two support rolls is springily or adjustably attached on the pivotally supported lever.

9. The pad printing machine of claim 8, wherein the springily or adjustably supported support roll contacts the second cam with a pretension.

10. The pad printing machine of claim 1, wherein the second cam has a first region associated with an ink withdrawal position and a second region associated with an inking position, with both the first and second regions shaped as a circular arc or a circle.

11. The pad printing machine of claim 10, wherein the second region extends over an angular range of 40° to 120°.

12. The pad printing machine of claim 10, wherein the second region extends over an angular range of 70° to 110°.

13. The pad printing machine of claim 10, wherein the second region extends over an angular range of about 100°.

14. The pad printing machine of claim 10, wherein the first region extends over an angular range of 40° to 165°.

15. The pad printing machine of claim 10, wherein the first region extends over an angular range of 70° to 155°.

16. The pad printing machine of claim 10, wherein the first region extends over an angular range of about 145°.

17. The pad printing machine of claim 1, wherein the printing pad is supported on a vertical linear guide.

18. The pad printing machine of claim 7, wherein the printing pad is supported on a vertical linear guide and the linear guide is attached with a sliding block in a fork-shaped receptacle of the pivotally supported lever.

19. The pad printing machine of claim 1, further comprising a counterweight operating on the holder.

20. The pad printing machine of claim 19, wherein the counterweight is pivotally or displaceably supported.

21. The pad printing machine of claim 1, comprising a single central driveshaft connected to a single drive and constructed to drive several control discs or several pad printing machines.

22. The pad printing machine of claim 21, wherein the single drive is an internal drive or an external drive.

* * * * *